US007070184B2

(12) United States Patent
Pollu

(10) Patent No.: US 7,070,184 B2
(45) Date of Patent: Jul. 4, 2006

(54) BALL GAME

(75) Inventor: Mati Pollu, Maardu (EE)

(73) Assignee: Disainiabi OU, Maardu (EE)

( * ) Notice: Subject to any disclaimer, the term of this patent is extended or adjusted under 35 U.S.C. 154(b) by 0 days.

(21) Appl. No.: 10/985,990

(22) Filed: Nov. 12, 2004

(65) Prior Publication Data

US 2005/0104284 A1 May 19, 2005

Related U.S. Application Data

(60) Provisional application No. 60/519,275, filed on Nov. 13, 2003.

(51) Int. Cl.
*A63F 7/00* (2006.01)

(52) U.S. Cl. ..... 273/123 R

(58) Field of Classification Search ..... 273/118 R, 273/119 R, 123 R; 473/162
See application file for complete search history.

(56) References Cited

U.S. PATENT DOCUMENTS

| | | | | | |
|---|---|---|---|---|---|
| 103,774 | A * | 5/1870 | Plumb | 273/118 R |
| 207,835 | A * | 9/1878 | Witsil | 273/123 R |
| 607,020 | A * | 7/1898 | Dodge | 273/127 B |
| 1,040,717 | A * | 10/1912 | Martineau | 273/118 R |
| 1,136,153 | A * | 4/1915 | Martineau et al. | 273/123 R |
| 1,174,411 | A * | 3/1916 | Halton | 273/123 R |
| 1,320,274 | A * | 10/1919 | Ramsey | 273/123 R |
| 1,541,980 | A * | 6/1925 | Luber | 273/390 |
| 3,811,677 | A * | 5/1974 | Saladrigas | 273/118 R |
| 4,203,604 | A * | 5/1980 | La Grange | 473/162 |
| 5,427,529 | A * | 6/1995 | Dunse | 434/167 |
| 5,980,263 | A * | 11/1999 | Conover | 434/322 |
| 2005/0104284 | A1 * | 5/2005 | Pollu | 273/123 R |

* cited by examiner

*Primary Examiner*—Raleigh W. Chiu
(74) *Attorney, Agent, or Firm*—Young & Thompson

(57) ABSTRACT

A ball game includes a scoring path, a ball, and device for hitting the ball. A player uses the device to hit the ball in the scoring path. The scoring path includes a portable flat goal unit having a group of holes with different diameters. The ball has a diameter smaller than the diameters of the holes in the goal unit. The ball has sides with different symbols, representing points earned by hitting the ball into the hole.

14 Claims, 2 Drawing Sheets

BALL GAME

BACKGROUND OF THE INVENTION

1. Field of the Invention

The present invention relates generally to golf-like ball games and more specifically it relates to a ball game apparatus having a scoring path, a ball and means for hitting the ball when playing the game as defined in the preamble of the independent claim.

2. Description of the Prior Art

Mini golf or mini putting games has been known for a long time. This kind of game apparatus has a set of runways combined with obstruction areas and golf green areas containing a hole at the end. The point of the game is to reach the hole with as fewer hits to the ball as possible. So it works much like a golf course but it has a smaller size.

A drawback of traditional mini golf games is that players are forced to go a mini golf club or location, where the game is assembled to play the game.

Australian patent specification AU-B 18913/97 discloses a mini golf game apparatus, which can be folded into a smaller and transferable size. However, the game apparatus comprises a lot of parts such as a panel where the player hits the ball, a group of panels with grass surface, a hole panel and back netting system. Accordingly a drawback of the mini golf game is that it has in spite of all complicated structure and it cannot be put together and vice versa to make pieces rapidly.

SUMMARY OF THE INVENTION

A primary object of the present invention is to provide a new golf-like game apparatus that will overcome the shortcomings of the prior art devices.

Another primary object of the invention is to provide a new ball game apparatus, which has simple construction and which accordingly can be easy put up anywhere, inside or outside.

Another object of the invention is to provide a new ball game apparatus, which has light weights, which is movable and which is easy to store.

All the objects can be achieved by means of a ball game apparatus described in the independent claim. The dependent claims describe preferred embodiments of the invention.

The present invention relates to a ball game apparatus having a scoring path, a ball and means for hitting the ball, where the ball is hit by means for hitting the ball in the scoring path when playing the game. According to the invention: scoring path comprises a portable flat goal unit having a group of holes with different diameters, and ball, having a diameter smaller than the diameters of the holes in the goal unit, comprises sides with different symbols where the symbols mean points when hitting a hole and showing up.

When playing the ball game apparatus according to the invention, the goal unit is laid on a surface such as a floor, the players taking part the game hit one after another the ball by the hitting means towards the goal unit and especially towards one of the holes, which goal unit is located in a relatively small distance from the hitting place and when the ball hits one of the holes the player scores the points depending on the hole and the symbol the ball shows up.

In a one embodiment of the invention the goal unit is a plate like unit with a simple geometrical form such as rectangular.

In another embodiment of the invention the ball is a cubic like homogeneous solid piece having six sides with different symbols in each side the symbols meaning points.

A further embodiment of the invention means for hitting the ball is a club.

Further embodiments of the invention will appear as the description proceeds.

To the accomplishment of the above and related embodiments, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
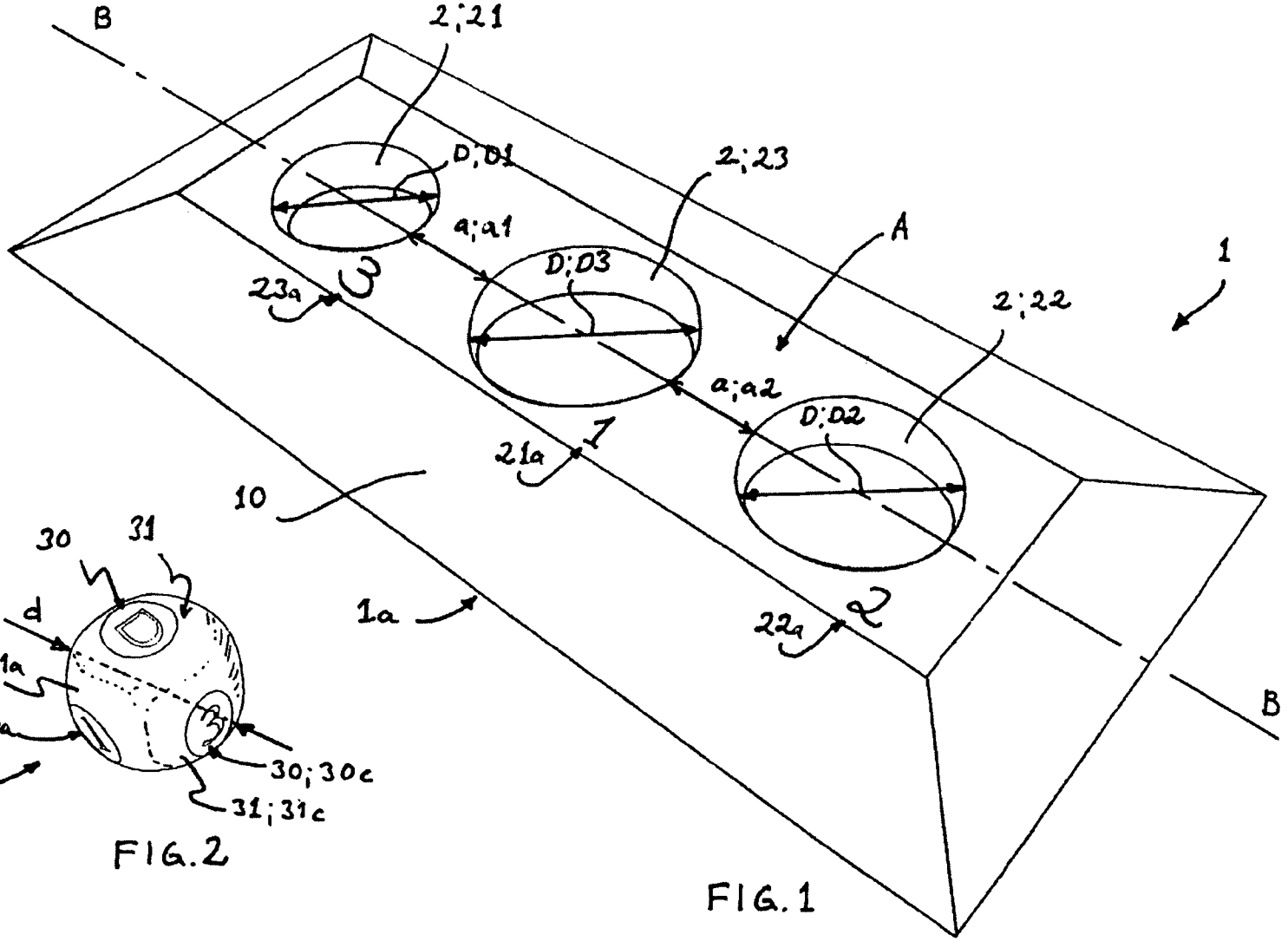
FIG. 1 is a perspective view of a goal unit according to one embodiment of the invention.

Turning now descriptively to the drawings, in which similar reference characters denote similar elements throughout the several views, the Figures illustrate a preferred embodiment of the ball game apparatus according to the invention.

Figure 2:
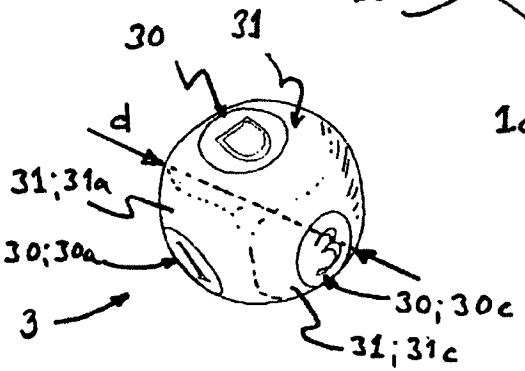
FIG. 2 is a perspective view of a ball according to one embodiment of the invention.
Figure 5:
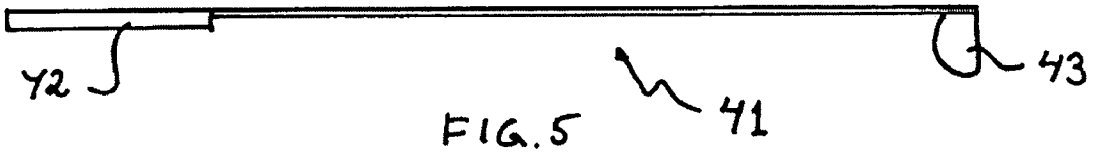
FIG. 5 is a side view of the ball presented in FIG. 2.
Figure 3:
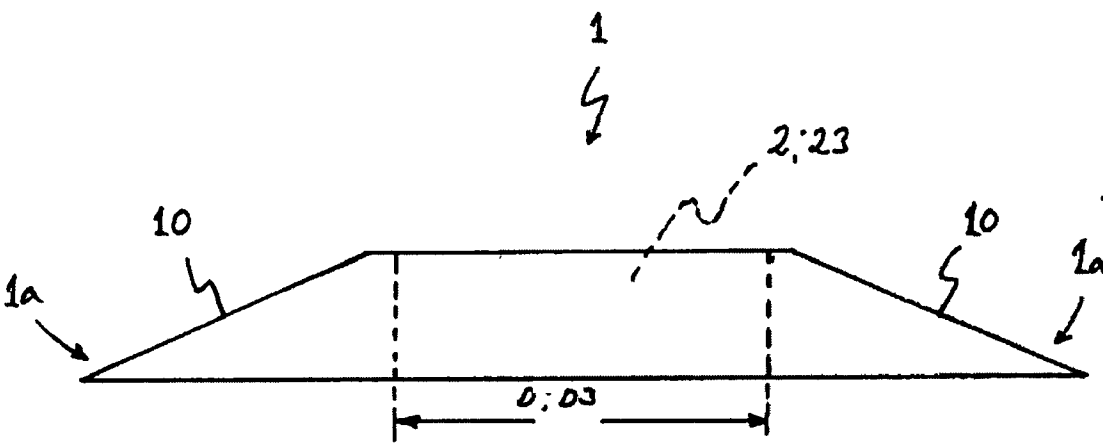
FIG. 3 is a side view of means for hitting the ball according to one embodiment of the invention.

As shown in FIGS. 1, 2 and 3, a ball game apparatus comprises a scoring path, a ball and means for hitting the ball in the scoring path when playing the game. Scoring path comprises a goal unit 1, which is portable and flat. The scoring path has a group of holes 2; 21, 22, 23 with different diameters D; D1, D2, D3. The number of holes 2 is preferably three, but it can be e.g. two or four or even more. The ball 3 has a diameter d in its maximum smaller than the diameters D of the holes 2 in the goal unit.

Further the ball comprises a group of sides 31 with different symbols 30. These symbols mean points when hitting and achieving a hole and showing up. The sides 31 can be as a marked areas, such as painted with different colors, in the surface of the ball. Alternatively, the sides can be marked only by symbols 30 or we can use painted areas with symbols. In one preferred embodiment each side is formed to the spherical surface of the ball as a cut so that the side is a plane.

In one preferred embodiment the goal unit 1 is a plate like unit with a simple geometrical form such as rectangular, which is shown in the drawings. Alternatively the goal unit can be round, elliptic or any combination of simple geometrical forms.

The thickness of the goal unit 1 is preferably between 0.5–1.0 inches, but it can be below or over the said limits. The total length of the goal unit is preferably 1.5–2 feet and broad less than above said, such as half of the total length or less, but we emphasize that these figures are just examples and that length can be more or less than the said figures. However, it should be pointed out that the goal unit is a portable unit and accordingly the length and the broad of the goal unit have limited values. p1 In one preferred embodiment the goal unit 1 has an inclined edge 10 at least on its one side 1*a*. The side having a slope i.e. inclined edge 10 is meant to be placed so, that it is in the direction towards a player. When the ball is hit to the goal unit, the ball can now climb easily and without changing direction on the top of the goal unit and further achieve one of the holes. Alternatively two or more sides of the goal unit can be provided with slopes 10 as we can see in FIGS. 1 and 3.

As shown in FIG. 1 the group of holes 2; 21, 22, 23 are located in the middle area A of the goal unit 1 in short distances a; a1, a2, such as 2–6 inches, with each other. In one preferred embodiment the group of holes 2; 21, 22, 23 are in line B—B. This is advantageous, because the goal unit can be placed with respect players so that the group of holes 2 are inclined or even in right angle with the direction the ball is coming. So it is easier to choose a hole among the holes where to play. Alternatively, the holes can be located freely on the goal unit.

It is advantageous that the holes 2; 21, 22, 23 in the goal unit have certain proportions with each other. Preferably the diameters D; D1, D2, D3 are arranged so that their proportions with each other are 1:1.5:3. Accordingly the diameters can be e.g. D1=2 inch, D2=3 inches and D3=6 inches.

In a preferred embodiment each hole in the group of holes 2; 21, 22, 23 is marked by a different symbol 21*a*, 22*a*, 23*a* such as a number. The symbol like number connected in this way to one of the holes is interpreted during the game so that when the ball hit the hole it is obtained points as much as the ball shows multiplied by the symbol or number of the hole. If it is symbol, we can choose the number it presents always we start the game. Further the symbol or number it presents or the actual number is the bigger the diameter of the hole is smaller.

Figure 4:
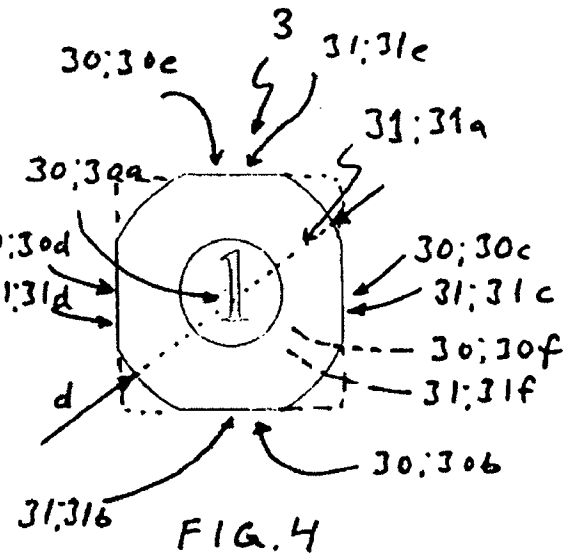
FIG. 4 is an elevation view of the goal unit presented in FIG. 1.

As shown in FIGS. 2 and 4 the ball 3 is a homogeneous ball like solid piece. The ball comprises in the preferred embodiment six sides 31; 31*a*, 31*b*, 31*c*, 31*d*, 31*f* with different symbols 30; 30*a*, 30*b*, 30*c*, 30*d*, 30*e*, 30*f* in each side. Alternatively, the ball can comprise less than six sides such as four or five sides or more than six sides such as seven or eight sides, but from the practical point of view it is found that six is good choice. Especially, if we provide dice like ball.

In a preferred embodiment the ball 3 is a cubic like homogeneous solid piece such as a dice.

In most advantageous embodiment the ball 3 is a cubic with round corners as shown especially in FIG. 2.

Different symbols 30; 30*a*, 30*b*, 30*c*, 30*d*, 30*e*, 30*f* in the sides 31 of the ball are preferably arranged in the following way. Five symbols 30; 30*a*, 30*b*, 30*c*, 30*d*, 30*e* of the six are numbers from 1 to 5 and the sixth symbol 30; 30*f* is another graphical sign or mark such as a letter, like D, or figure having special meaning such as extra high score in the game.

The diameter d, especially maximum diameter, of the ball 3 is e.g. 1.5 inches, but it can be smaller such as 1 inch or bigger such as 2 inches.

Means 4 for hitting the ball can be practically any kind of device having a stick 41 or stem and one end of it an end member 43 for hitting the ball. It is useful and comfortable, if the other end of the stick is provided with a handle 42, but is not necessary. Means for hitting the ball is preferably a club 4 as shown in FIG. 3.

The game apparatus according to the invention can be played in many rules. However, the basic way to play proceeds as follows. When we want to play the game, the goal unit 1 is laid on a surface such as a floor or ground. The players taking part the game hit one after another the ball 3 by the hitting means such as a club 4 towards the goal unit 1 and especially towards one of the holes 2; 21, 22, 23, which goal unit is located in a relatively small distance, such as 3–6 feet, from the hitting place. When the ball 3 hits one of the holes 2 the player scores the points depending on the hole i.e. the first, second or third hole 21, 22 or 23 and the symbol such as number 1–5 or a special symbol, like D, the ball shows up.

An example of specific rules of the game played the game apparatus according to the invention goes as follows. The game is played until a fixed score is achieved. The scoring path, especially the goal unit 1, is laid on a flat surface e.g. against a wall of the room with one of its edge. The ball is then placed in the beforehand-agreed position e.g. four feet from the goal unit 1 in right angle against the line B—B of holes 2. Each player can, according to earlier agreement, hit the ball for 3 to 10 times for scoring as much points as his/hers tactics, skill and luck allows. The goal unit 1 has in one preferred embodiment three holes 2; 21, 22, 23 with the different diameters D; D1, D2, D3 and sizes which are marked with symbols: 3×, 1× and 2×, respectively. The scores of each player, i.e. hit with the ball into any of the holes, are multiplied by the factor (i.e. presented by the symbol) of the hole 2 that was hit: the first hole 21 three times, the second hole 22 once and third hole 23 twice. The ball 3 is provided with the six sides 31 where five sides have numbers 1–5 and one side with a symbol such as letter "D". If the player hit any hole 2; 21, 22, 23 by the ball 3 with letter "D" upside, then the player gets extra points, such as 25 points, more. If a player does not use up all the possible hits he/she actually has, for example, when the ball 3 hits any of the holes 2 on the first hit, then the player can at once try to collect further points within the limits of the number of remaining hits. In this case, the remaining hits are used one at a time, from agreed position where the game started. When the agreed number of hits has been used up, the next player starts hitting the ball 3. The game goes on, until one of the players achieves the fixed score and wins.

While certain novel features of this invention have been shown and described and are pointed out in the annexed claims, it is not intended to be limited to the details above, since it will be understood that various omissions, modifications, substitutions and changes in the forms and details of the apparatus illustrated can be made by those skilled in the art without departing in any way from the spirit of the present invention.

The invention claimed is:

1. A ball game apparatus, comprising:

a scoring path, a ball, and a means for hitting the ball, the ball being hit by the means for hitting into the scoring path when playing the game, wherein, the scoring path comprises a portable flat goal unit having a group of holes with different diameters, the ball has a diameter smaller than the diameters of the holes in the goal unit, the ball comprises sides with different symbols, each symbol meaning points when achieving a hole and showing up the symbol, the goal unit has an inclined edge along at least one side, each hole in the group of holes is marked by a different symbol, and the ball is a solid homogeneous cube with rounded arcuate corners having six sides with different symbols in each side.

2. A ball game apparatus as claimed in claim 1 wherein the goal unit is a plate unit with a geometrical form taken from the group consisting of a rectangular form, a round form and an elliptic form.

3. A ball game apparatus as claimed in claim 2 wherein the thickness of the goal unit is between 0.5–1.0 inches.

4. A ball game apparatus as claimed in claim 1 wherein the group of holes is located in the middle area of the goal unit in short distances with each other.

5. A ball game apparatus as claimed in claim 4 wherein the group of holes is in line.

6. A ball game apparatus as claimed in claim 4 wherein the holes in the goal unit have different diameters.

7. A ball game apparatus as claimed in claim 1 wherein five symbols of the six symbols are numbers from 1 to 5 and the sixth symbol is another graphical sign having a special meaning.

8. A ball game apparatus as claimed in claim 7 wherein the sixth symbol is one of a letter and a figure having a special meaning indicating extra high score in the game.

9. A ball game apparatus as claimed in claim 1 wherein the means for hitting the ball is a club.

10. A ball game apparatus, comprising:

a ball having smoothly rounded corners free of flat surfaces and planar faces, each face marked with a different scoring symbol;

a portable goal unit with, along a longest longitudinal axis, a single straight-line row of at least three differently diametered and marked scoring holes, the goal unit having a flat planar uppermost surface and a tapered edge along an entire outermost perimeter; and a ball-hitting part for hitting the ball into the goal unit.

11. The apparatus of claim 10, wherein, the ball has a diameter smaller than a diameter of any of the holes, and the ball has a shape of a sphere planed to present eight smoothly rounded corners free of flat surfaces and six planar faces.

12. The apparatus of claim 11, wherein, goal unit is a plate having in a thickness from 0.5 to 1.0 inches, a length from 1.5 to 2 feet, and a width no more than half the length.

13. The apparatus of claim 12, wherein, a first of the holes has a first diameter, a second of the holes has a diameter 1.5 times the first diameter, and a third of the holds has a diameter 3 times the first diameter.

14. The apparatus of claim 10, wherein, the ball has a shape of a sphere planed to present smoothly rounded corners free of flat surfaces and one of four planar sides, five planar sides, seven planar sides, and eight planar sides.

* * * * *